US010565978B2

(12) United States Patent
Maziewski et al.

(10) Patent No.: US 10,565,978 B2
(45) Date of Patent: Feb. 18, 2020

(54) ULTRASONIC ATTACK PREVENTION FOR SPEECH ENABLED DEVICES

(71) Applicant: INTEL CORPORATION, Santa Clara, CA (US)

(72) Inventors: Przemyslaw Maziewski, Gdansk (PL); Jan Banas, Gdansk (PL); Piotr Klinke, Szczecin (PL); Pawel Pach, Gdansk (PL); Jedrzej Prysko, Gdansk (PL); Roksana Sokolowska-Kostyk, Gdansk (PL); Dominik Stanczak, Gdansk (PL); Pawel Trella, Gdansk (PL)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 16/118,719

(22) Filed: Aug. 31, 2018

(65) Prior Publication Data

US 2019/0043471 A1 Feb. 7, 2019

(51) Int. Cl.

| | |
|---|---|
| ***G10K 11/178*** | (2006.01) |
| ***H04R 3/00*** | (2006.01) |
| ***G10L 21/0208*** | (2013.01) |

(52) U.S. Cl.

CPC ..... *G10K 11/1783* (2018.01); *G10L 21/0208* (2013.01); *H04R 3/00* (2013.01); *G10L 2021/02085* (2013.01)

(58) Field of Classification Search

CPC .. G10K 11/1783; G10K 11/16; G10K 11/175; H04K 3/00; H04K 3/41;

(Continued)

(56) References Cited

U.S. PATENT DOCUMENTS

2017/0064246 A1* 3/2017 Kline ..... H04N 5/913
2018/0068647 A1* 3/2018 Kim ..... G10K 11/175

(Continued)

OTHER PUBLICATIONS

Zang et al, "DolphinAtack: Inaudible Voice Commands", In Proceedings of the ACM Conference on Computer and Communications Security, 2017, 15 pages.

(Continued)

*Primary Examiner* — Jason R Kurr

(74) *Attorney, Agent, or Firm* — Finch & Maloney PLLC

(57) ABSTRACT

Techniques are provided for defending against an ultrasonic attack on a speech enabled device. A methodology implementing the techniques according to an embodiment includes detecting voice activity in an audio signal received by the device and generating an ultrasonic jamming signal in response to the detection. The jamming signal is broadcast over a loudspeaker for up to the duration of the detected voice activity to defend against the ultrasonic attack. According to another embodiment, the ultrasonic jamming signal is generated in response to detection of a wake-on-voice key phrase in the received audio signal, and the jamming signal is broadcast over the loudspeaker for a time duration selected to be less than or equal to a time window during which spoken commands are accepted by the device following the wake-on-voice key phrase detection. The jamming signal may include white or colored noise, combinations of tones, and/or a periodic sweep frequency.

24 Claims, 7 Drawing Sheets

(58) Field of Classification Search
CPC .. H04K 3/42; H04K 3/80; H04K 3/82; H04K 3/825; H04K 3/94; H04K 2203/12; G10L 21/0208; G10L 25/78; G10L 2021/02085; H04R 3/00; H04R 3/005
See application file for complete search history.

(56) References Cited

U.S. PATENT DOCUMENTS

| | | | | |
|---|---|---|---|---|
| 2019/0114497 | A1* | 4/2019 | Lesso | G06K 9/00906 |
| 2019/0115033 | A1* | 4/2019 | Lesso | G01S 7/52004 |
| 2019/0115046 | A1* | 4/2019 | Lesso | G10L 25/93 |
| 2019/0122691 | A1* | 4/2019 | Roy | G10L 21/06 |

OTHER PUBLICATIONS

Liam Tung, "Alexa, Cortana, Google, Siri user? Watch out for these inaudible command attacks", retrieved from the Internet: https://www.zdnet.com/article/alexa-cortana-googlesiri-user-watch-out-for-these-inaudible-command-attacks/ [copy retrieved Aug. 24, 2018] 16 pages.

Song and Mittal, "Inaudible Voice Commands", arXiv:1708.07238v1, Aug. 24, 2017, 3 pages.

Roy et al, "Inaudible Voice Commands: The Long-Range Attack and Defense", Proceedings of the 15th UNENIX Symposium on Networked Systems Design and Implementation (NSDI '18), Apr. 2018, 15 pages.

FB-05 Cheap Ultrasonic Mini Micro Piezo Speaker With Multi Application (FBELE), retrieved from the Internet: https://www.alibaba.com/product-detail/FB-05-cheap-ultrasonic-mini-micro_60381871578.html?spm=a2700.7724857.main07.1.fac47690C70bv7 [copy retrieved Aug. 24, 2018] 6 pages.

* cited by examiner

200

ULTRASONIC ATTACK PREVENTION FOR SPEECH ENABLED DEVICES

BACKGROUND

Speech enabled devices, such as smart-speakers, personal assistants, home management systems, and the like, are configured to perform actions in response to spoken user requests and commands. It has recently been discovered that these devices are vulnerable to ultrasonic attacks which can pose a threat to the security of their operation. In some such scenarios, ultrasonic signals, which are inaudible to humans, can be broadcast into the environment from various sources. These ultrasonic signals can cause the device to wake from a sleep state and act on commands embedded in the ultrasonic signals, without the user's knowledge.

BRIEF DESCRIPTION OF THE DRAWINGS

Features and advantages of embodiments of the claimed subject matter will become apparent as the following Detailed Description proceeds, and upon reference to the Drawings, wherein like numerals depict like parts.

Figure 1:
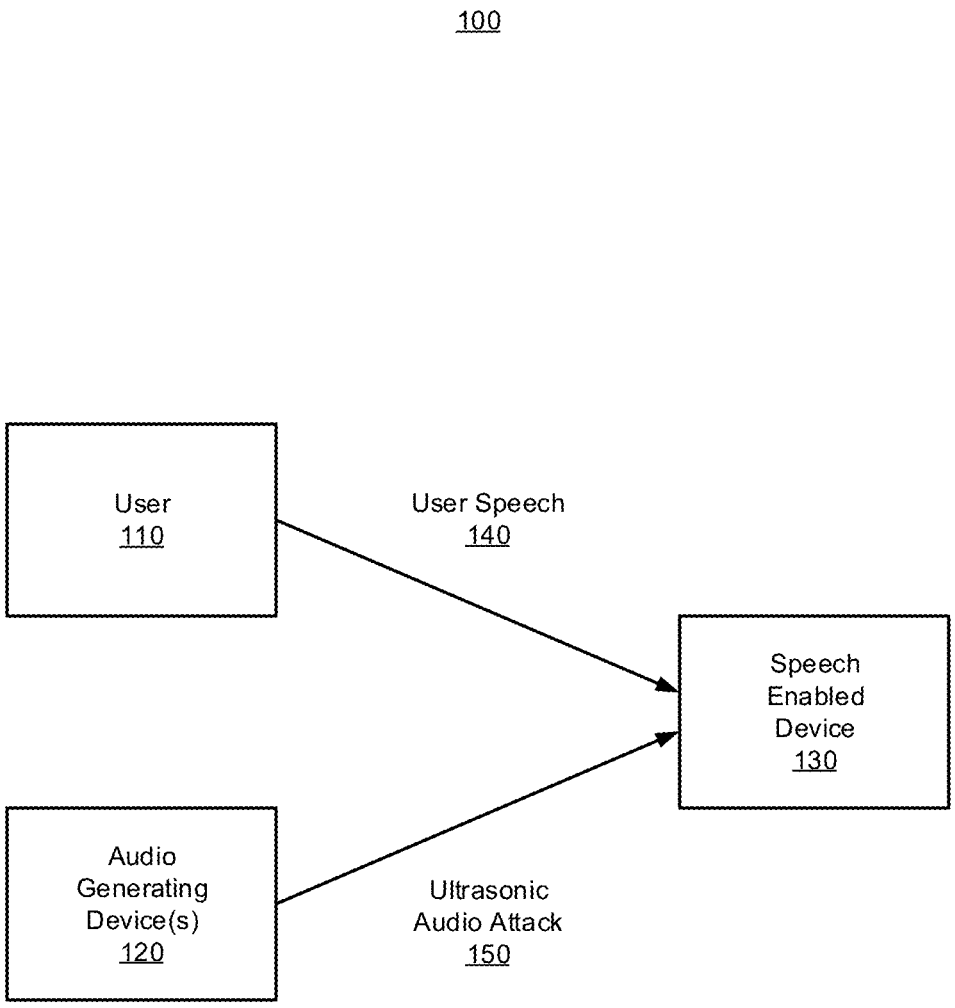
FIG. 1 illustrates an ultrasonic audio attack on a speech enabled device, in accordance with certain embodiments of the present disclosure.

Although the following Detailed Description will proceed with reference being made to illustrative embodiments, many alternatives, modifications, and variations thereof will be apparent in light of this disclosure.

DETAILED DESCRIPTION

Techniques are provided for defending against an ultrasonic attack that can compromise the security of a speech enabled device, such as a smart-speaker, personal assistant, home management system, and the like, which are configured to perform actions in response to user spoken requests. These devices are vulnerable, however, to attack from ultrasonic (inaudible) signals which can command the devices to perform unintended and/or malicious tasks. These ultrasonic signals exploit nonlinearities in the microphones and/or pre-amplifiers of the devices, which generate intermodulation distortion products that can shift the signal from the ultrasonic frequency region down to the normal speech frequency region. The devices can thus be spoofed into waking from a sleep state and acting on commands embedded in the ultrasonic signals, without the user's knowledge. Embodiments of the present disclosure provide techniques for generating and broadcasting ultrasonic jamming signals to counter the ultrasonic attack signals, with little or no interference to legitimate spoken commands from the user. This is possible because of the nature of the interaction of the jamming signal with the attack signal versus the interaction of the jamming signal with the legitimate voice signal, as will be explained in greater detail below. In some embodiments, the jamming signals can be broadcast from a loudspeaker of the speech enabled device.

The disclosed techniques can be implemented, for example, in a computing system or a software product executable or otherwise controllable by such systems, although other embodiments will be apparent. The system or product is configured to perform ultrasonic attack prevention in a speech enabled device. In accordance with an embodiment, a methodology to implement these techniques includes detecting voice activity in an audio signal received by the device and generating an ultrasonic jamming signal in response to the detection. The jamming signal is broadcast over a loudspeaker for a period of time less than or equal to the duration of the detected voice activity to defend against the ultrasonic attack. According to another embodiment, the ultrasonic jamming signal is generated in response to detection of a wake-on-voice key phrase in the received audio signal, and the jamming signal is broadcast over the loudspeaker for a time duration selected to be less than or equal to a time window during which spoken commands are accepted by the device following the wake-on-voice key phrase detection. In some embodiments, the jamming signal may include white or colored noise, combinations of tones, and/or a periodic frequency sweep.

As will be appreciated, the techniques described herein may provide an efficient defense against ultrasonic attacks on speech enabled devices with reduced cost and complexity, compared to existing techniques which require expensive microphones with lower non-linearities, or the use of complex analysis techniques to detect characteristics of the ultrasonic attack which can be masked by common low frequency background noises. The disclosed techniques can be implemented on a broad range of platforms including smartphones, smart-speakers, laptops, tablets, video conferencing systems, gaming systems, smart home control systems, and robotic systems. These techniques may further be implemented in hardware or software or a combination thereof.

FIG. 1 illustrates an ultrasonic audio attack scenario 100 on a speech enabled device, in accordance with certain embodiments of the present disclosure. A speech enabled device 130 is shown to receive audio signals containing speech 140 from a user 110 of the device. In some embodiments, the speech enabled device 130 may be a smart-speaker, personal assistant, home management system, or any device configured to receive an audio signal containing spoken commands, recognize the commands, and act on those commands. In some embodiments, the device may be connected to the Internet and/or a local network to facilitate the performance of the requested tasks. For example, the user may say "computer, play song xyz," or "computer, set the temperature to 70 degrees," or "computer, send the following email to my friend Joe." In these examples, the term "computer" is used as a wake-up key phrase to get the attention of the device 130, which may have been in a low-power or sleep state.

Also shown is an audio generating device 120 (which in some embodiments may include one or more such devices) capable of generating and broadcasting an ultrasonic audio attack signal 150. Device 120 could be an entertainment system, such as a television or an internet enabled hi-fi system, or any other device capable of broadcasting ultrasonic audio signals embedded by a nefarious party (e.g., hackers). These ultrasonic signals may contain commands that, when processed as described below, cause the speech enabled device 130 to perform malicious tasks without the knowledge of the user. For example, commands may be provided to instruct the device 130 to transfer sensitive information to unauthorized recipients or to perform fraudulent financial transactions. The ultrasonic attack exploits the fact that speech enabled devices 130 typically employ relatively low-cost microphones which introduce nonlinear effects. These nonlinear effects cause intermodulation distortion as illustrated in FIG. 2 and described below.

Figure 2:
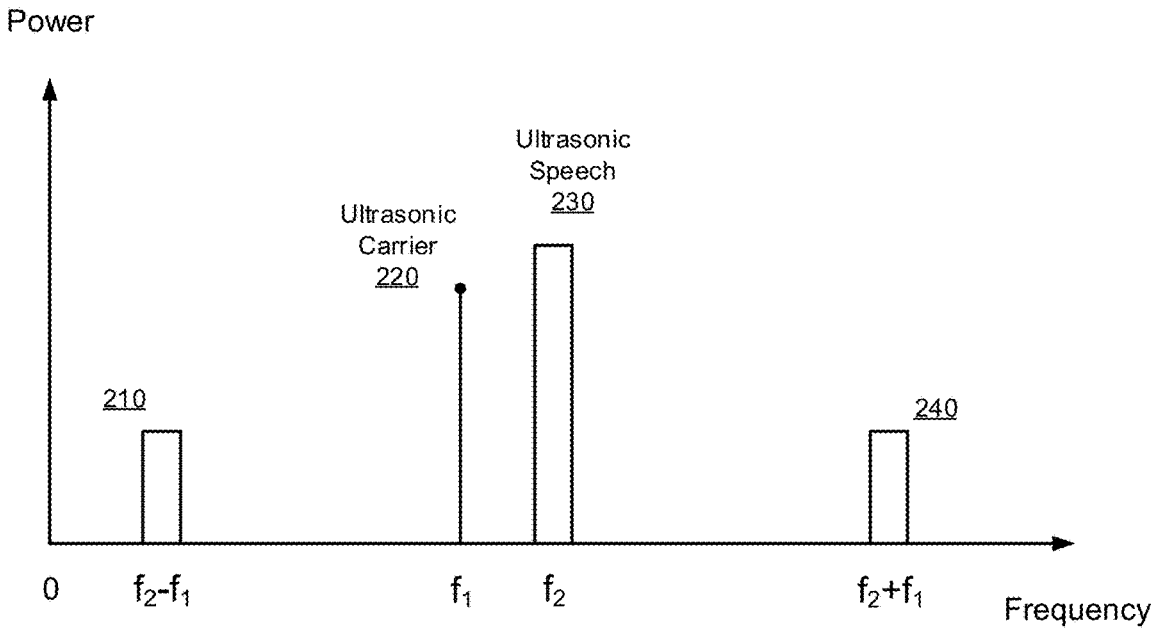
FIG. 2 illustrates intermodulation distortion of signals associated with an ultrasonic audio attack, in accordance with certain embodiments of the present disclosure.

FIG. 2 illustrates intermodulation distortion 200 of signals associated with an ultrasonic audio attack, in accordance with certain embodiments of the present disclosure. The ultrasonic attack is shown to include two components, an ultrasonic carrier (e.g., tone signal) 220 at a first frequency $f_1$, and a speech signal transposed to an ultrasonic range 230 such that it is centered about a second frequency $f_2$. Nonlinearities in the microphones of speech enabled device 130 cause intermodulation distortion which generates products of the ultrasonic carrier 220 and the ultrasonic speech 230 at sum and difference frequencies $f_2-f_1$ 210 and $f_2+f_1$ 240. By choosing appropriate values for frequencies $f_1$ and $f_2$, the ultrasonic speech signal 230 may be frequency downshifted to a frequency range associated with normal human speech. Thus, the downshifted speech signal may be recognized and acted upon by the speech enabled device 230, unknown to the user 110.

Figure 3:
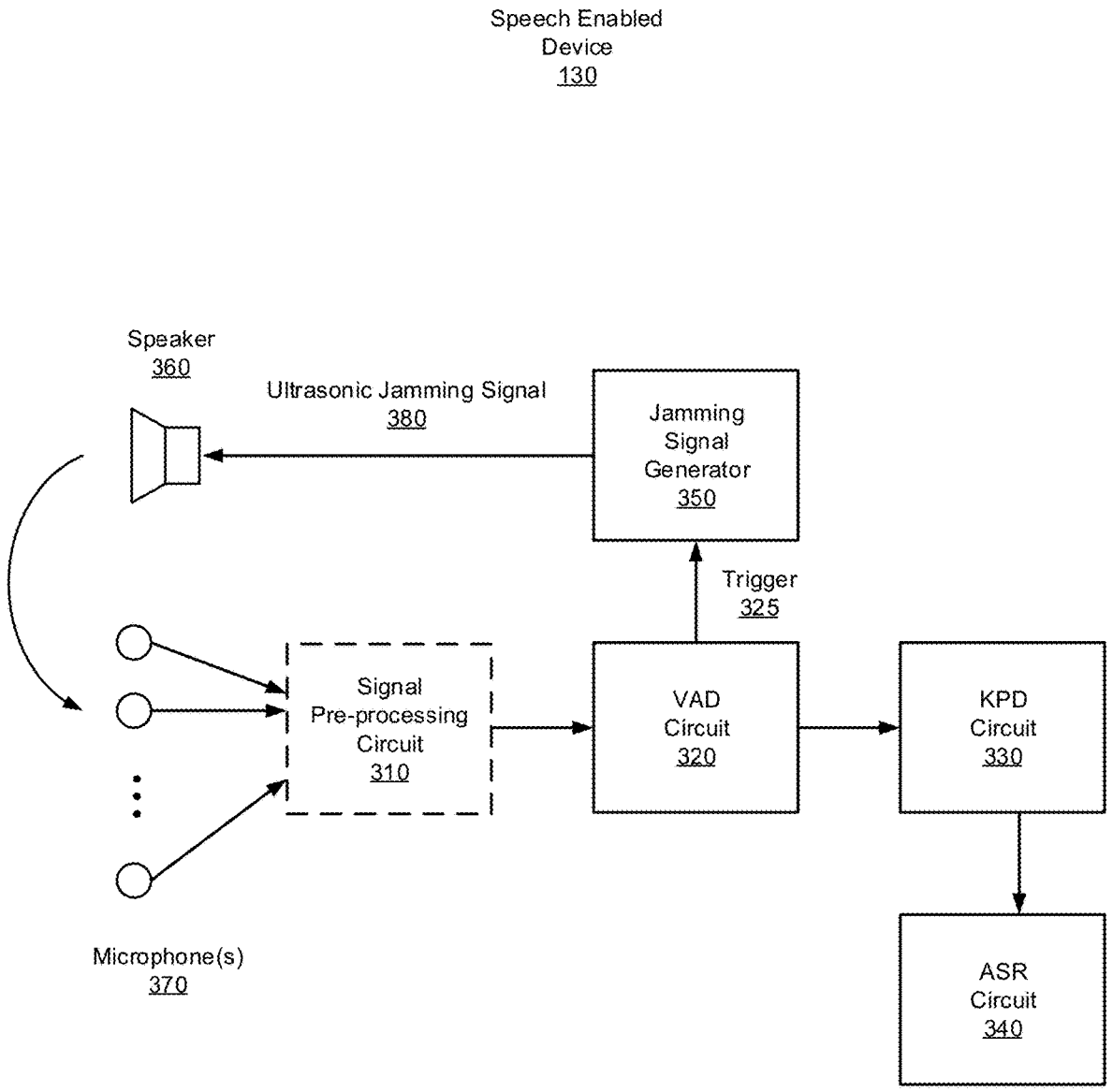
FIG. 3 is a block diagram of a system for ultrasonic attack prevention on a speech enabled device, configured in accordance with certain embodiments of the present disclosure.

FIG. 3 is a block diagram of a system for ultrasonic attack prevention on a speech enabled device 130, configured in accordance with certain embodiments of the present disclosure. The system is shown to include one or more microphones 370, an optional signal pre-processing circuit 310, a voice activity detection (VAD) circuit 320, a key phrase detection (KPD) circuit 330, an automatic speech recognition (ASR) circuit 340, a jamming signal generator 350, and a loudspeaker 360.

Microphone(s) 370 are configured to receive audio signals including speech 140 from a user of the device. In some embodiments, multiple microphones may be employed in an array configuration to facilitate beamforming or to otherwise improve the quality of the receiving audio signal. In some embodiments, an optional signal pre-processing circuit 310 is employed and configured to perform automatic gain control, acoustic echo cancellation, beamforming, and/or any other desired signal enhancement operations.

VAD circuit 320 is configured to detect voice activity (e.g., the presence of speech) in the received audio signal, using known techniques in light of the present disclosure. The detection of voice serves as a trigger 325 supplied to the jamming signal generator 350, the operation of which will be explained below.

KPD circuit 330 is configured to detect a wake-on-voice key phrase (such as the term "computer" as in the examples above), to wake the system from a lower power or sleep state. Of course, in some embodiments, terms other than "computer" may be used for the key phrase. Key phrase detection may be performed using known techniques in light of the present disclosure.

ASR circuit 340 is configured to recognize speech following the key phrase in the audio signal, using known techniques in light of the present disclosure. The recognized speech may then be employed by the device 130 to perform desired actions based on the requests and commands of the user.

Jamming signal generator 350 is configured to generate an ultrasonic jamming signal 380 and broadcast that signal through loudspeaker 360 in response to the trigger 325 generated by the voice activity detection circuit 320. Loudspeaker 360 is configured to be capable of broadcasting at ultrasonic frequencies in addition to normal speech range frequencies. In some embodiments, a separate loudspeaker may be employed to handle broadcasts in the ultrasonic frequency range. Because the jamming signal is ultrasonic it should not be a cause for disturbance of the user. In some embodiments, the jamming signal may be broadcast for a period of time less than or equal to a duration of the detected voice activity to conserve power.

In the event that an ultrasonic attack is not in progress, which would typically be the case, the jamming signal will not be received by the microphones 370, as the ultrasonic carrier 220 is not present and the intermodulation components 210 will not be generated. In other words, the jamming signal will be ignored by the system, because the ultrasonic frequency of the jamming signal is outside the frequency range associated with normal speech. Said differently, the jamming signal is benign to legitimate user speech signals. If, however, an ultrasonic attack is in progress, then the ultrasonic carrier component 220 of the attacking signal will cause the ultrasonic jamming signal 380 to mix down to the normal speech frequency range (due to microphone nonlinearity) and interfere with the frequency shifted ultrasonic speech component 230 of the attacking signal, thus masking or jamming the attack. The disclosed techniques therefore eliminate the need to perform any type of analysis on the received signals to detect the presence of an ultrasonic attack. The jamming signal can be used regardless of whether the speech is a legitimate user command or a malicious attack command.

In some embodiments, the speaker 360 will be in relatively close proximity to the microphones 370 and thus the power level of the ultrasonic jamming signal 380 may be set to a relatively low level in comparison to the anticipated power level of the ultrasonic attack signal 150 since audio generating device 120 will typically be located at a further distance from the microphones 370.

Figure 4:
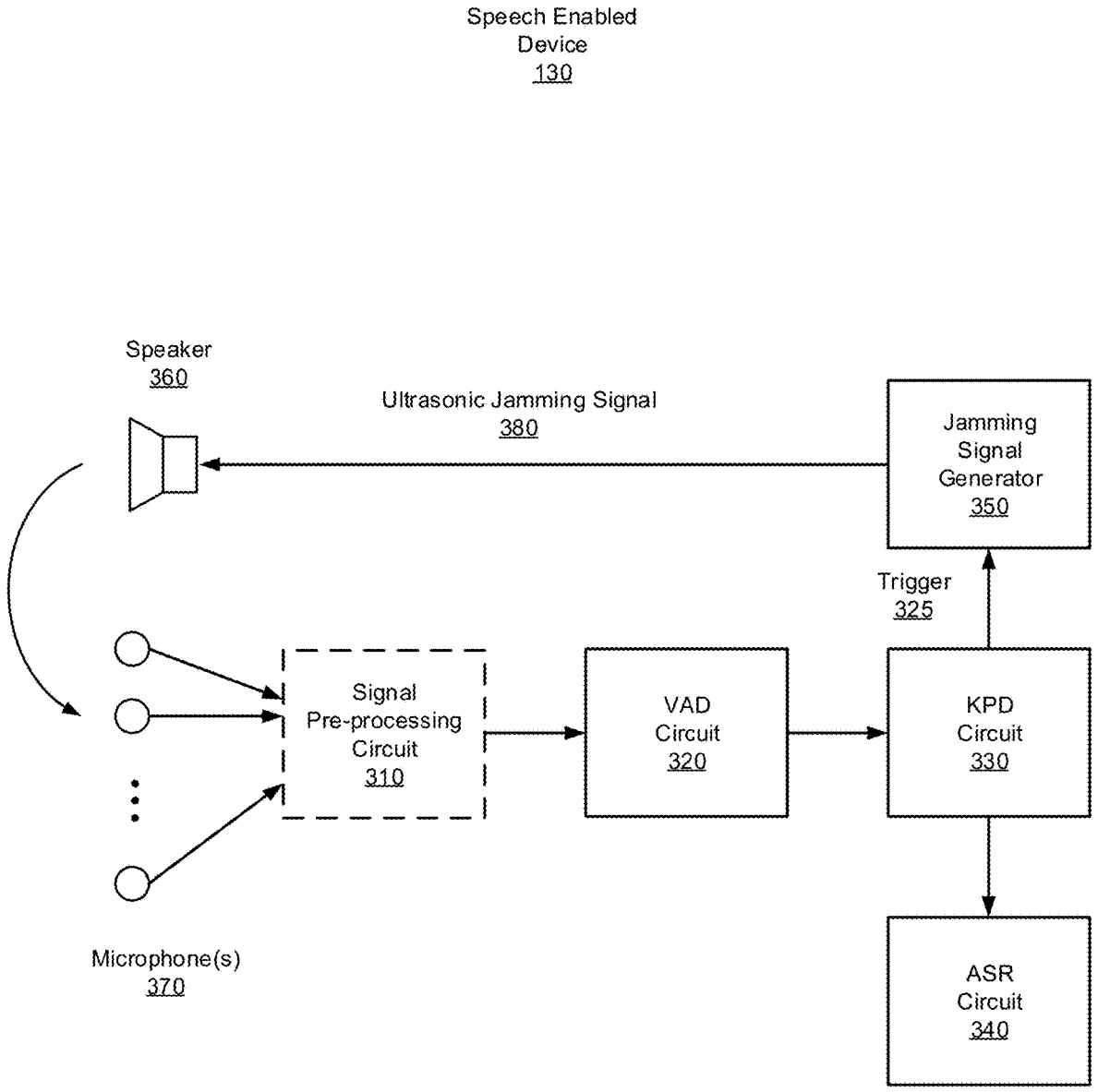
FIG. 4 is a block diagram of a system for ultrasonic attack prevention on a speech enabled device, configured in accordance with certain other embodiments of the present disclosure.

FIG. 4 is a block diagram of a system for ultrasonic attack prevention on a speech enabled device 130, configured in accordance with certain other embodiments of the present disclosure. The system is shown to include one or more microphones 370, an optional signal pre-processing circuit 310, a voice activity detection (VAD) circuit 320, a key phrase detection (KPD) circuit 330, an automatic speech recognition (ASR) circuit 340, a jamming signal generator 350, and a loudspeaker 360. The system illustrated in FIG. 4 is substantially the same as the system illustrated in FIG. 3 with one exception: trigger 325 is generated by KPD circuit 330 rather than VAD circuit 320. Triggering the jamming signal generator 350 based on key phrase detection rather than voice activity detection may result in additional power savings since a key phrase will typically be detected less often than voice activity. In this embodiment, the jamming signal may be broadcast for a duration limited to the window of time during which spoken commands are accepted following the wake-on-voice key phrase detection.

Figure 5:
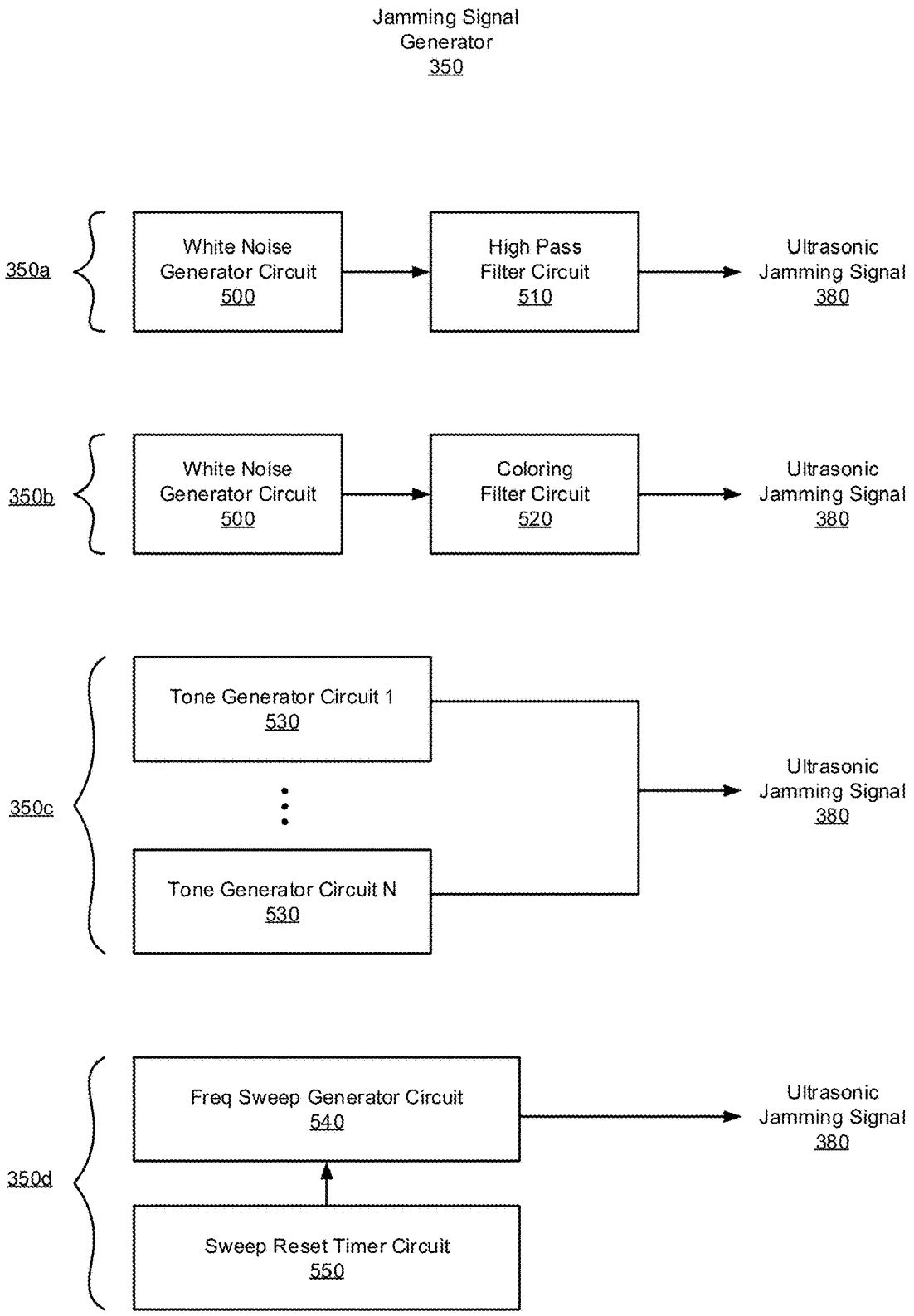
FIG. 5 is a block diagram of a jamming signal generator, configured in accordance with certain embodiments of the present disclosure.

FIG. 5 is a block diagram of a jamming signal generator 350, configured in accordance with certain embodiments of the present disclosure. Four variations of the jamming signal generator are shown 350*a*, 350*b*, 350*c*, and 350*d*.

Jamming signal generator 350*a* is shown to include a white noise generator circuit 500 and a high pass filter circuit 510. The white noise generator circuit 500 is configured to generate white noise and the high pass filter circuit 510 is configured to filter the white noise with a cut-off frequency of 18 kHz to generate the ultrasonic jamming signal 380. In some embodiments, other cut-off frequency values may be selected.

Jamming signal generator 350*b* is shown to include white noise generator circuit 500 and a coloring filter circuit 520. Coloring filter circuit 520 is configured to color the white noise to match a frequency response associated with speech signals to generate the ultrasonic jamming signal 380. Alternatively, in some embodiments, the coloring may be configured to match sensitivity of the speech enabled device to the ultrasonic attack. For example, the jamming signal may be strengthened in frequency regions associated with a higher susceptibility to the attack.

Jamming signal generator 350*c* is shown to include a number of tone generator circuits 530 which are configured to generate frequency tones in the range of 18 kHz to 50 kHz at 2 kHz frequency spacing between the tones to generate the ultrasonic jamming signal 380. In some embodiments, the frequency range and spacing may be adjusted to any selected value. In some embodiments, the frequency spacing may be chosen as an integral value. Additionally, the amplitudes of the tones can be set to the same level or to varying levels to match a specific color, in a manner similar to jamming signal generator 350*b*.

Jamming signal generator 350*d* is shown to include a frequency sweep generator circuit 540 and a sweep reset timer circuit 550. Frequency sweep generator circuit 540 is configured to generate a linear frequency sweep signal ranging from 18 kHz to 50 kHz over a time period determined by the sweep reset timer circuit 550 to generate the ultrasonic jamming signal 380. In some embodiments the time period may be on the order of 0.5 seconds or greater. In some embodiments, the frequency sweep range and the time period may be adjusted to any selected value. Additionally, the amplitudes of the sweep frequencies can be set to the same level or to varying levels to match a specific color, in a manner similar to jamming signal generator 350*b*. In some embodiments, nonlinear frequency sweep signals may also be generated.

In some embodiments, one or more of these variations of jamming signal generators may be dynamically selected to provide the jamming signal based on any appropriate operational criteria.

Methodology

Figure 6:
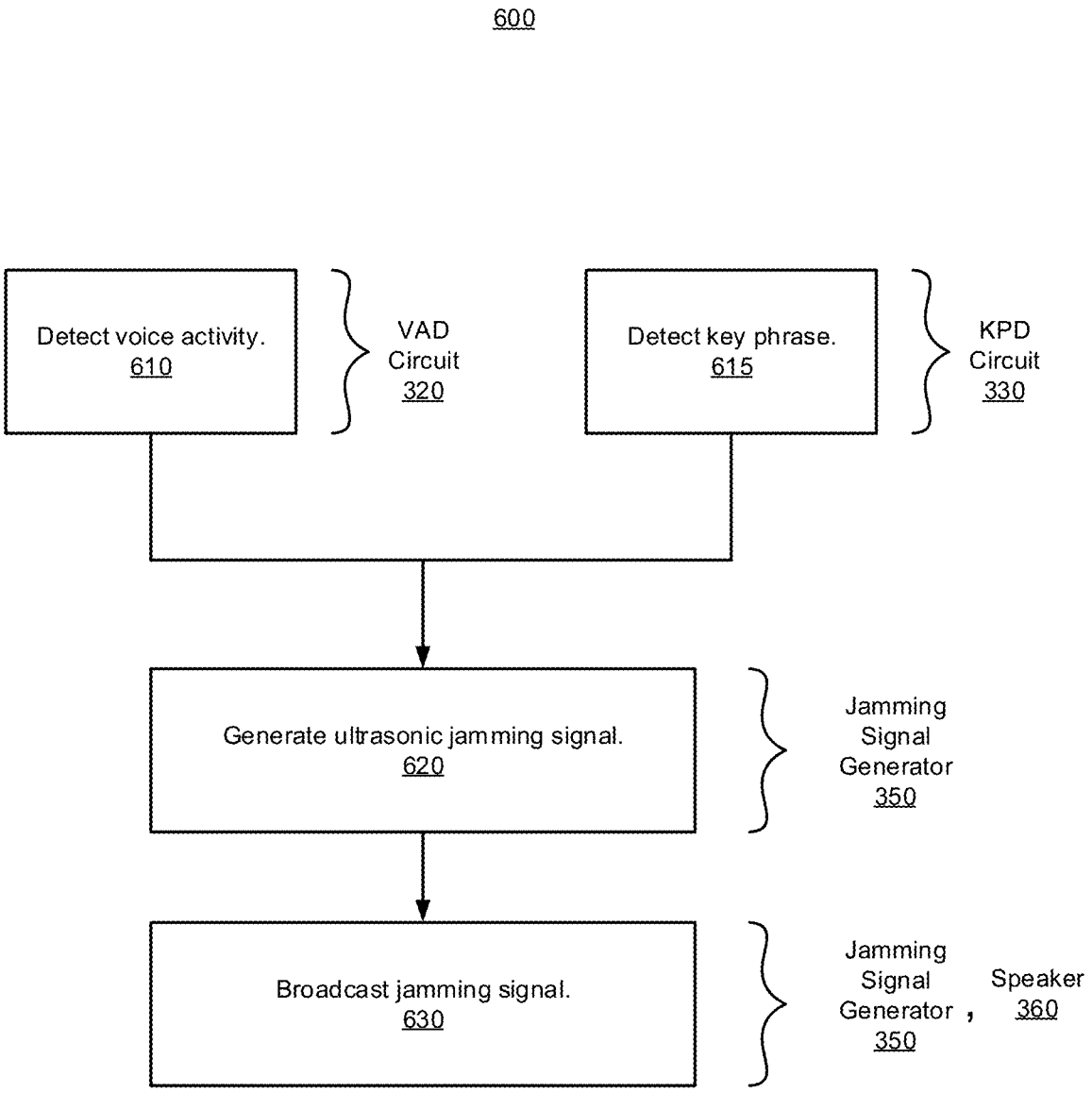
FIG. 6 is a flowchart illustrating a methodology for ultrasonic attack prevention on a speech enabled device, in accordance with certain embodiments of the present disclosure.

FIG. 6 is a flowchart illustrating an example method 600 for ultrasonic attack prevention on a speech enabled device, in accordance with certain embodiments of the present disclosure. As can be seen, the example method includes a number of phases and sub-processes, the sequence of which may vary from one embodiment to another. However, when considered in the aggregate, these phases and sub-processes form a process for the prevention of ultrasonic attacks, in accordance with certain of the embodiments disclosed herein. These embodiments can be implemented, for example, using the system architecture illustrated in FIGS. 3-5, as described above. However other system architectures can be used in other embodiments, as will be apparent in light of this disclosure. To this end, the correlation of the various functions shown in FIG. 6 to the specific components illustrated in the other figures is not intended to imply any structural and/or use limitations. Rather, other embodiments may include, for example, varying degrees of integration wherein multiple functionalities are effectively performed by one system. For example, in an alternative embodiment a single module having decoupled sub-modules can be used to perform all of the functions of method 600. Thus, other embodiments may have fewer or more modules and/or sub-modules depending on the granularity of implementation. In still other embodiments, the methodology depicted can be implemented as a computer program product including one or more non-transitory machine-readable mediums that when executed by one or more processors cause the methodology to be carried out. Numerous variations and alternative configurations will be apparent in light of this disclosure.

As illustrated in FIG. 6, in an embodiment, method 600 for ultrasonic attack prevention commences by detecting, at operation 610, voice activity in an audio signal received through one or more microphones of a speech enabled device. The audio signal may include speech from a user of the device, an ultrasonic audio attack signal, or combination of both. In an alternative embodiment, at operation 615, rather than detecting voice activity, a wake on voice key phrase is detected.

Next, at operation 620, an ultrasonic jamming signal is generated in response to the detection of either the voice activity or the wake on voice key phrase. At operation 630, the ultrasonic jamming signal is broadcast over a loudspeaker to prevent an ultrasonic attack on the speech enabled device.

Of course, in some embodiments, additional operations may be performed, as previously described in connection with the system. For example, the ultrasonic jamming signal may be broadcast for a time duration selected to be less than or equal to the duration of the detected voice activity. In another embodiment, the ultrasonic jamming signal may be broadcast for a time duration selected to be less than or equal to a time window during which spoken commands are accepted, by the speech enabled device, following the wake-on-voice key phrase detection.

In some embodiments, the jamming signal may include high pass filtered white noise, colored noise shaped to match a frequency response associated with speech signals, combinations of tones, and/or a periodic sweep frequency.

Example System

Figure 7:
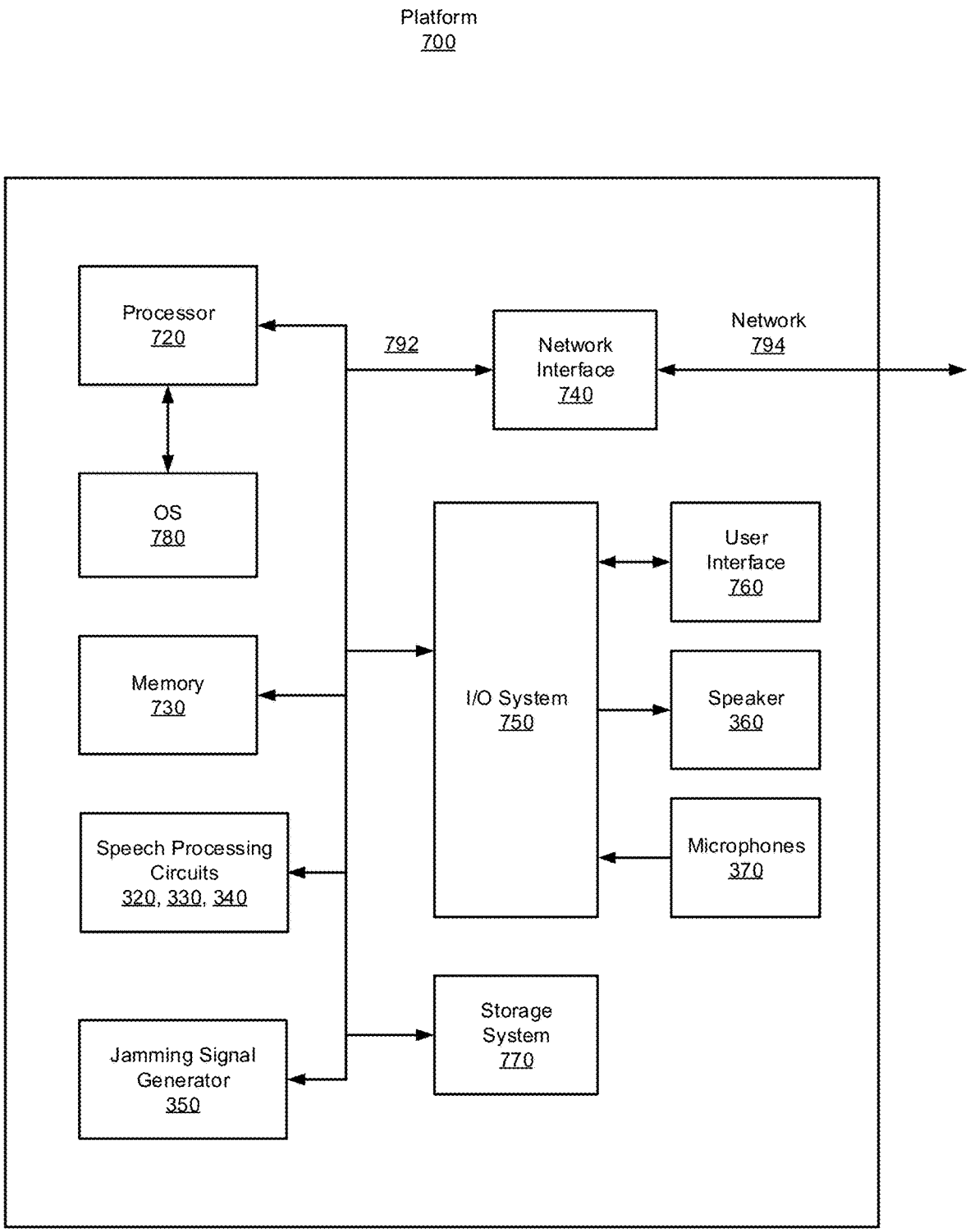
FIG. 7 is a block diagram schematically illustrating a speech enabled device platform configured to perform ultrasonic attack prevention, in accordance with certain embodiments of the present disclosure.

FIG. 7 illustrates an example platform 700, configured in accordance with certain embodiments of the present disclosure, to perform ultrasonic attack prevention. In some embodiments, platform 700 may be hosted on, or otherwise be incorporated into a speech enabled device, (for example, a smartphone, smart-speaker, smart-tablet, personal assistant, smart home management system), a personal computer, workstation, laptop computer, ultra-laptop computer, tablet, touchpad, portable computer, handheld computer, palmtop computer, messaging device, data communication device, wearable device, and so forth. Any combination of different devices may be used in certain embodiments.

In some embodiments, platform 700 may comprise any combination of a processor 720, a memory 730, speech processing circuits 320, 330, 340, jamming signal generator 350, a network interface 740, an input/output (I/O) system 750, a user interface 760, a microphone array 370, a loudspeaker 360, and a storage system 770. As can be further seen, a bus and/or interconnect 792 is also provided to allow for communication between the various components listed above and/or other components not shown. Platform 700 can be coupled to a network 794 through network interface 740 to allow for communications with other computing devices, platforms, devices to be controlled, or other resources. Other componentry and functionality not reflected in the block diagram of FIG. 7 will be apparent in light of this disclosure, and it will be appreciated that other embodiments are not limited to any particular hardware configuration.

Processor 720 can be any suitable processor, and may include one or more coprocessors or controllers, such as an audio processor, a graphics processing unit, or hardware accelerator, to assist in control and processing operations associated with platform 700. In some embodiments, the processor 720 may be implemented as any number of processor cores. The processor (or processor cores) may be any type of processor, such as, for example, a microprocessor, an embedded processor, a digital signal processor (DSP), a graphics processor (GPU), a network processor, a field programmable gate array or other device configured to execute code. The processors may be multithreaded cores in that they may include more than one hardware thread context (or "logical processor") per core. Processor 720 may be implemented as a complex instruction set computer (CISC) or a reduced instruction set computer (RISC) processor. In some embodiments, processor 720 may be configured as an x86 instruction set compatible processor.

Memory 730 can be implemented using any suitable type of digital storage including, for example, flash memory and/or random-access memory (RAM). In some embodiments, the memory 730 may include various layers of memory hierarchy and/or memory caches as are known to those of skill in the art. Memory 730 may be implemented as a volatile memory device such as, but not limited to, a RAM, dynamic RAM (DRAM), or static RAM (SRAM) device. Storage system 770 may be implemented as a non-volatile storage device such as, but not limited to, one or more of a hard disk drive (HDD), a solid-state drive (SSD), a universal serial bus (USB) drive, an optical disk drive, tape drive, an internal storage device, an attached storage device, flash memory, battery backed-up synchronous DRAM (SDRAM), and/or a network accessible storage device. In some embodiments, storage 770 may comprise technology to increase the storage performance enhanced protection for valuable digital media when multiple hard drives are included.

Processor 720 may be configured to execute an Operating System (OS) 780 which may comprise any suitable operating system, such as Google Android (Google Inc., Mountain View, Calif.), Microsoft Windows (Microsoft Corp., Redmond, Wash.), Apple OS X (Apple Inc., Cupertino, Calif.), Linux, or a real-time operating system (RTOS). As will be appreciated in light of this disclosure, the techniques provided herein can be implemented without regard to the particular operating system provided in conjunction with platform 700, and therefore may also be implemented using any suitable existing or subsequently-developed platform.

Network interface circuit 740 can be any appropriate network chip or chipset which allows for wired and/or wireless connection between other components of device platform 700 and/or network 794, thereby enabling platform 700 to communicate with other local and/or remote computing systems, servers, cloud-based servers, and/or other resources. Wired communication may conform to existing (or yet to be developed) standards, such as, for example, Ethernet. Wireless communication may conform to existing (or yet to be developed) standards, such as, for example, cellular communications including LTE (Long Term Evolution), Wireless Fidelity (Wi-Fi), Bluetooth, and/or Near Field Communication (NFC). Exemplary wireless networks include, but are not limited to, wireless local area networks, wireless personal area networks, wireless metropolitan area networks, cellular networks, and satellite networks.

I/O system 750 may be configured to interface between various I/O devices and other components of device platform 700. I/O devices may include, but not be limited to, user interface 760, microphone array 370, and loudspeaker 360. User interface 760 may include devices (not shown) such as a display element, touchpad, keyboard, and mouse, etc. I/O system 750 may include a graphics subsystem configured to perform processing of images for rendering on the display element. Graphics subsystem may be a graphics processing unit or a visual processing unit (VPU), for example. An analog or digital interface may be used to communicatively couple graphics subsystem and the display element. For example, the interface may be any of a high definition multimedia interface (HDMI), DisplayPort, wireless HDMI, and/or any other suitable interface using wireless high definition compliant techniques. In some embodiments, the graphics subsystem could be integrated into processor 720 or any chipset of platform 700.

It will be appreciated that in some embodiments, the various components of platform 700 may be combined or integrated in a system-on-a-chip (SoC) architecture. In some embodiments, the components may be hardware components, firmware components, software components or any suitable combination of hardware, firmware or software.

Jamming signal generator 350 is configured to generate and broadcast an ultrasonic jamming signal in response to voice activity detection or key phrase detection, to prevent an ultrasonic attack, as described previously. Jamming signal generator 350 may include any or all of the circuits/components illustrated in FIG. 5, as described above. These components can be implemented or otherwise used in conjunction with a variety of suitable software and/or hardware that is coupled to or that otherwise forms a part of platform 700. These components can additionally or alternatively be implemented or otherwise used in conjunction with user I/O devices that are capable of providing information to, and receiving information and commands from, a user.

In some embodiments, these circuits may be installed local to platform 700, as shown in the example embodiment of FIG. 7. Alternatively, platform 700 can be implemented in a client-server arrangement wherein at least some functionality associated with these circuits is provided to platform 700 using an applet, such as a JavaScript applet, or other downloadable module or set of sub-modules. Such remotely accessible modules or sub-modules can be provisioned in real-time, in response to a request from a client computing system for access to a given server having resources that are of interest to the user of the client computing system. In such embodiments, the server can be local to network 794 or remotely coupled to network 794 by one or more other networks and/or communication channels. In some cases, access to resources on a given network or computing system may require credentials such as usernames, passwords, and/or compliance with any other suitable security mechanism.

In various embodiments, platform 700 may be implemented as a wireless system, a wired system, or a combination of both. When implemented as a wireless system, platform 700 may include components and interfaces suitable for communicating over a wireless shared media, such as one or more antennae, transmitters, receivers, transceivers, amplifiers, filters, control logic, and so forth. An example of wireless shared media may include portions of a wireless spectrum, such as the radio frequency spectrum and so forth. When implemented as a wired system, platform 700 may include components and interfaces suitable for communicating over wired communications media, such as input/output adapters, physical connectors to connect the input/output adaptor with a corresponding wired communications medium, a network interface card (NIC), disc controller, video controller, audio controller, and so forth. Examples of wired communications media may include a wire, cable metal leads, printed circuit board (PCB), backplane, switch fabric, semiconductor material, twisted pair wire, coaxial cable, fiber optics, and so forth.

Various embodiments may be implemented using hardware elements, software elements, or a combination of both. Examples of hardware elements may include processors, microprocessors, circuits, circuit elements (for example, transistors, resistors, capacitors, inductors, and so forth), integrated circuits, ASICs, programmable logic devices, digital signal processors, FPGAs, logic gates, registers, semiconductor devices, chips, microchips, chipsets, and so forth. Examples of software may include software components, programs, applications, computer programs, application programs, system programs, machine programs, operating system software, middleware, firmware, software modules, routines, subroutines, functions, methods, procedures, software interfaces, application program interfaces, instruction sets, computing code, computer code, code segments, computer code segments, words, values, symbols, or any combination thereof. Determining whether an embodiment is implemented using hardware elements and/or software elements may vary in accordance with any number of factors, such as desired computational rate, power level, heat tolerances, processing cycle budget, input data rates, output data rates, memory resources, data bus speeds, and other design or performance constraints.

Some embodiments may be described using the expression "coupled" and "connected" along with their derivatives. These terms are not intended as synonyms for each other. For example, some embodiments may be described using the terms "connected" and/or "coupled" to indicate that two or more elements are in direct physical or electrical contact with each other. The term "coupled," however, may also mean that two or more elements are not in direct contact with each other, but yet still cooperate or interact with each other.

The various embodiments disclosed herein can be implemented in various forms of hardware, software, firmware, and/or special purpose processors. For example, in one embodiment at least one non-transitory computer readable storage medium has instructions encoded thereon that, when executed by one or more processors, cause one or more of the ultrasonic attack prevention methodologies disclosed herein to be implemented. The instructions can be encoded using a suitable programming language, such as C, C++, object oriented C, Java, JavaScript, Visual Basic .NET, Beginner's All-Purpose Symbolic Instruction Code (BASIC), or alternatively, using custom or proprietary instruction sets. The instructions can be provided in the form of one or more computer software applications and/or applets that are tangibly embodied on a memory device, and that can be executed by a computer having any suitable architecture. In one embodiment, the system can be hosted on a given web site and implemented, for example, using JavaScript or another suitable browser-based technology. For instance, in certain embodiments, the system may leverage processing resources provided by a remote computer system accessible via network 794. In other embodiments, the functionalities disclosed herein can be incorporated into other voice-enabled devices and speech-based software applications, such as, for example, automobile control/navigation, smart-home management, entertainment, personal assistant, and robotic applications. The computer software applications disclosed herein may include any number of different modules, submodules, or other components of distinct functionality, and can provide information to, or receive information from, still other components. These modules can be used, for example, to communicate with input and/or output devices such as a display screen, a touch sensitive surface, a printer, and/or any other suitable device. Other componentry and functionality not reflected in the illustrations will be apparent in light of this disclosure, and it will be appreciated that other embodiments are not limited to any particular hardware or software configuration. Thus, in other embodiments platform 700 may comprise additional, fewer, or alternative subcomponents as compared to those included in the example embodiment of FIG. 7.

The aforementioned non-transitory computer readable medium may be any suitable medium for storing digital information, such as a hard drive, a server, a flash memory, and/or random-access memory (RAM), or a combination of memories. In alternative embodiments, the components and/or modules disclosed herein can be implemented with hardware, including gate level logic such as a field-programmable gate array (FPGA), or alternatively, a purpose-built semiconductor such as an application-specific integrated circuit (ASIC). Still other embodiments may be implemented with a microcontroller having a number of input/output ports for receiving and outputting data, and a number of embedded routines for carrying out the various functionalities disclosed herein. It will be apparent that any suitable combination of hardware, software, and firmware can be used, and that other embodiments are not limited to any particular system architecture.

Some embodiments may be implemented, for example, using a machine readable medium or article which may store an instruction or a set of instructions that, if executed by a machine, may cause the machine to perform a method, process, and/or operations in accordance with the embodiments. Such a machine may include, for example, any suitable processing platform, computing platform, computing device, processing device, computing system, processing system, computer, process, or the like, and may be implemented using any suitable combination of hardware and/or software. The machine readable medium or article may include, for example, any suitable type of memory unit, memory device, memory article, memory medium, storage device, storage article, storage medium, and/or storage unit, such as memory, removable or non-removable media, erasable or non-erasable media, writeable or rewriteable media, digital or analog media, hard disk, floppy disk, compact disk read only memory (CD-ROM), compact disk recordable (CD-R) memory, compact disk rewriteable (CD-RW) memory, optical disk, magnetic media, magneto-optical media, removable memory cards or disks, various types of digital versatile disk (DVD), a tape, a cassette, or the like. The instructions may include any suitable type of code, such as source code, compiled code, interpreted code, executable code, static code, dynamic code, encrypted code, and the like, implemented using any suitable high level, low level, object oriented, visual, compiled, and/or interpreted programming language.

Unless specifically stated otherwise, it may be appreciated that terms such as "processing," "computing," "calculating,"

"determining," or the like refer to the action and/or process of a computer or computing system, or similar electronic computing device, that manipulates and/or transforms data represented as physical quantities (for example, electronic) within the registers and/or memory units of the computer system into other data similarly represented as physical entities within the registers, memory units, or other such information storage transmission or displays of the computer system. The embodiments are not limited in this context.

The terms "circuit" or "circuitry," as used in any embodiment herein, are functional and may comprise, for example, singly or in any combination, hardwired circuitry, programmable circuitry such as computer processors comprising one or more individual instruction processing cores, state machine circuitry, and/or firmware that stores instructions executed by programmable circuitry. The circuitry may include a processor and/or controller configured to execute one or more instructions to perform one or more operations described herein. The instructions may be embodied as, for example, an application, software, firmware, etc. configured to cause the circuitry to perform any of the aforementioned operations. Software may be embodied as a software package, code, instructions, instruction sets and/or data recorded on a computer-readable storage device. Software may be embodied or implemented to include any number of processes, and processes, in turn, may be embodied or implemented to include any number of threads, etc., in a hierarchical fashion. Firmware may be embodied as code, instructions or instruction sets and/or data that are hard-coded (e.g., nonvolatile) in memory devices. The circuitry may, collectively or individually, be embodied as circuitry that forms part of a larger system, for example, an integrated circuit (IC), an application-specific integrated circuit (ASIC), a system-on-a-chip (SoC), desktop computers, laptop computers, tablet computers, servers, smartphones, etc. Other embodiments may be implemented as software executed by a programmable control device. In such cases, the terms "circuit" or "circuitry" are intended to include a combination of software and hardware such as a programmable control device or a processor capable of executing the software. As described herein, various embodiments may be implemented using hardware elements, software elements, or any combination thereof. Examples of hardware elements may include processors, microprocessors, circuits, circuit elements (e.g., transistors, resistors, capacitors, inductors, and so forth), integrated circuits, application specific integrated circuits (ASIC), programmable logic devices (PLD), digital signal processors (DSP), field programmable gate array (FPGA), logic gates, registers, semiconductor device, chips, microchips, chip sets, and so forth.

Numerous specific details have been set forth herein to provide a thorough understanding of the embodiments. It will be understood by an ordinarily-skilled artisan, however, that the embodiments may be practiced without these specific details. In other instances, well known operations, components and circuits have not been described in detail so as not to obscure the embodiments. It can be appreciated that the specific structural and functional details disclosed herein may be representative and do not necessarily limit the scope of the embodiments. In addition, although the subject matter has been described in language specific to structural features and/or methodological acts, it is to be understood that the subject matter defined in the appended claims is not necessarily limited to the specific features or acts described herein. Rather, the specific features and acts described herein are disclosed as example forms of implementing the claims.

Further Example Embodiments

The following examples pertain to further embodiments, from which numerous permutations and configurations will be apparent.

Example 1 is at least one non-transitory computer readable storage medium having instructions encoded thereon that, when executed by one or more processors, cause a process to be carried out for ultrasonic attack prevention, the process comprising: detecting voice activity in an audio signal received by a speech enabled device; generating an ultrasonic jamming signal in response to the detection; and broadcasting the ultrasonic jamming signal over a loudspeaker to prevent an ultrasonic attack on the speech enabled device.

Example 2 includes the subject matter of Example 1, wherein broadcasting the ultrasonic jamming signal includes broadcasting the ultrasonic jamming signal for a broadcast time duration selected to be less than or equal to a duration of the detected voice activity.

Example 3 includes the subject matter of Examples 1 or 2, wherein the ultrasonic jamming signal comprises a high pass filtered white noise signal, the high pass filter configured with a cut-off frequency at 18 kHz.

Example 4 includes the subject matter of any of Examples 1-3, wherein the ultrasonic jamming signal comprises a plurality of tones ranging from 18 kHz to a selected upper frequency at an integral frequency spacing between the tones.

Example 5 includes the subject matter of any of Examples 1-4, wherein the ultrasonic jamming signal comprises a periodic linear frequency sweep signal ranging from 18 kHz to a selected upper frequency over a period greater than or equal to 0.5 seconds.

Example 6 includes the subject matter of any of Examples 1-5, wherein the ultrasonic jamming signal comprises a colored noise signal, the coloring selected to match a frequency response associated with speech signals.

Example 7 is at least one non-transitory computer readable storage medium having instructions encoded thereon that, when executed by one or more processors, cause a process to be carried out for ultrasonic attack prevention, the process comprising: detecting a wake-on-voice key phrase in an audio signal received by a speech enabled device; generating an ultrasonic jamming signal in response to the detected wake-on-voice key phrase; and broadcasting the ultrasonic jamming signal over a loudspeaker to prevent an ultrasonic attack on the speech enabled device.

Example 8 includes the subject matter of Example 7, wherein broadcasting the ultrasonic jamming signal includes broadcasting the ultrasonic jamming signal for a broadcast time duration selected to be less than or equal to a time window during which spoken commands are accepted following the wake-on-voice key phrase detection.

Example 9 includes the subject matter of Example 7 or 8, wherein the ultrasonic jamming signal comprises a high pass filtered white noise signal, the high pass filter configured with a cut-off frequency at 18 kHz.

Example 10 includes the subject matter of any of Examples 7-9, wherein the ultrasonic jamming signal comprises a plurality of tones ranging from 18 kHz to a selected upper frequency at an integral frequency spacing between the tones.

Example 11 includes the subject matter of any of Examples 7-10, wherein the ultrasonic jamming signal comprises a periodic linear frequency sweep signal ranging from 18 kHz to a selected upper frequency over a period greater than or equal to 0.5 seconds.

Example 12 includes the subject matter of any of Examples 7-11, wherein the ultrasonic jamming signal comprises a colored noise signal, the coloring selected to match a frequency response associated with speech signals.

Example 13 is a system for ultrasonic attack prevention, the system comprising: a voice activity detection circuit to detect voice activity in an audio signal received by a speech enabled device; and a jamming signal generator circuit to generate an ultrasonic jamming signal in response to the detected voice activity, the jamming signal to be broadcast over a loudspeaker to prevent an ultrasonic attack on the speech enabled device.

Example 14 includes the subject matter of Example 13 wherein the jamming signal generator circuit is further to broadcast the ultrasonic jamming signal for a broadcast time duration selected to be less than or equal to a duration of the detected voice activity.

Example 15 includes the subject matter of Examples 13 or 14, wherein the ultrasonic jamming signal comprises a high pass filtered white noise signal, the high pass filter configured with a cut-off frequency at 18 kHz.

Example 16 includes the subject matter of any of Examples 13-15, wherein the ultrasonic jamming signal comprises a plurality of tones ranging from 18 kHz to a selected upper frequency at an integral frequency spacing between the tones.

Example 17 includes the subject matter of any of Examples 13-16, wherein the ultrasonic jamming signal comprises a periodic linear frequency sweep signal ranging from 18 kHz to a selected upper frequency over a period greater than or equal to 0.5 seconds.

Example 18 includes the subject matter of any of Examples 13-17, wherein the ultrasonic jamming signal comprises a colored noise signal, the coloring selected to match a frequency response associated with speech signals.

Example 19 is a system for ultrasonic attack prevention, the system comprising: a key phrase detection circuit to detect a wake-on-voice key phrase in an audio signal received by a speech enabled device; and a jamming signal generator circuit to generate an ultrasonic jamming signal in response to the detected wake-on-voice key phrase, the jamming signal to be broadcast over a loudspeaker to prevent an ultrasonic attack on the speech enabled device.

Example 20 includes the subject matter of Example 19, wherein the jamming signal generator circuit is further to broadcast the ultrasonic jamming signal for a broadcast time duration selected to be less than or equal to a time window during which spoken commands are accepted following the wake-on-voice key phrase detection.

Example 21 includes the subject matter of Examples 19 or 20, wherein the ultrasonic jamming signal comprises a high pass filtered white noise signal, the high pass filter configured with a cut-off frequency at 18 kHz.

Example 22 includes the subject matter of any of Examples 19-21, wherein the ultrasonic jamming signal comprises a plurality of tones ranging from 18 kHz to a selected upper frequency at an integral frequency spacing between the tones.

Example 23 includes the subject matter of any of Examples 19-22, wherein the ultrasonic jamming signal comprises a periodic linear frequency sweep signal ranging from 18 kHz to a selected upper frequency over a period greater than or equal to 0.5 seconds.

Example 24 includes the subject matter of any of Examples 19-23, wherein the ultrasonic jamming signal comprises a colored noise signal, the coloring selected to match a frequency response associated with speech signals.

The terms and expressions which have been employed herein are used as terms of description and not of limitation, and there is no intention, in the use of such terms and expressions, of excluding any equivalents of the features shown and described (or portions thereof), and it is recognized that various modifications are possible within the scope of the claims. Accordingly, the claims are intended to cover all such equivalents. Various features, aspects, and embodiments have been described herein. The features, aspects, and embodiments are susceptible to combination with one another as well as to variation and modification, as will be understood by those having skill in the art. The present disclosure should, therefore, be considered to encompass such combinations, variations, and modifications. It is intended that the scope of the present disclosure be limited not by this detailed description, but rather by the claims appended hereto. Future filed applications claiming priority to this application may claim the disclosed subject matter in a different manner, and may generally include any set of one or more elements as variously disclosed or otherwise demonstrated herein.

What is claimed is:

1. At least one non-transitory computer readable storage medium having instructions encoded thereon that, when executed by one or more processors, cause a process to be carried out for ultrasonic attack defense, the process comprising:

detecting voice activity in an audio signal received by a speech enabled device;

generating an ultrasonic jamming signal in response to the detection;

broadcasting the ultrasonic jamming signal over a loudspeaker; and mixing, by a microphone of the speech enabled device, the broadcast ultrasonic jamming signal with an ultrasonic attack signal, to defend against an ultrasonic attack on the speech enabled device.

2. The computer readable storage medium of claim 1, wherein broadcasting the ultrasonic jamming signal includes broadcasting the ultrasonic jamming signal for a broadcast time duration selected to be less than or equal to a duration of the detected voice activity.

3. The computer readable storage medium of claim 1, wherein the ultrasonic jamming signal comprises a high pass filtered white noise signal generated by application of a high pass filter configured with a cut-off frequency at 18 kHz.

4. The computer readable storage medium of claim 1, wherein the ultrasonic jamming signal comprises a plurality of tones ranging from 18 kHz to a selected upper frequency at an integral frequency spacing between the tones.

5. The computer readable storage medium of claim 1, wherein the ultrasonic jamming signal comprises a periodic linear frequency sweep signal ranging from 18 kHz to a selected upper frequency over a period greater than or equal to 0.5 seconds.

6. The computer readable storage medium of claim 1, wherein the ultrasonic jamming signal comprises a colored noise signal, the coloring selected to match a frequency response associated with speech signals.

7. At least one non-transitory computer readable storage medium having instructions encoded thereon that, when executed by one or more processors, cause a process to be carried out for ultrasonic attack defense the process comprising:

detecting a wake-on-voice key phrase in an audio signal received by a speech enabled device;

generating an ultrasonic jamming signal in response to the detected wake-on-voice key phrase;

broadcasting the ultrasonic jamming signal over a loudspeaker; and mixing, by a microphone of the speech enabled device, the broadcast ultrasonic jamming signal with an ultrasonic attack signal, to defend against an ultrasonic attack on the speech enabled device.

8. The computer readable storage medium of claim 7, wherein broadcasting the ultrasonic jamming signal includes broadcasting the ultrasonic jamming signal for a broadcast time duration selected to be less than or equal to a time window during which spoken commands are accepted following the wake-on-voice key phrase detection.

9. The computer readable storage medium of claim 7, wherein the ultrasonic jamming signal comprises a high pass filtered white noise signal generated by application of a high pass filter configured with a cut-off frequency at 18 kHz.

10. The computer readable storage medium of claim 7, wherein the ultrasonic jamming signal comprises a plurality of tones ranging from 18 kHz to a selected upper frequency at an integral frequency spacing between the tones.

11. The computer readable storage medium of claim 7, wherein the ultrasonic jamming signal comprises a periodic linear frequency sweep signal ranging from 18 kHz to a selected upper frequency over a period greater than or equal to 0.5 seconds.

12. The computer readable storage medium of claim 7, wherein the ultrasonic jamming signal comprises a colored noise signal, the coloring selected to match a frequency response associated with speech signals.

13. A system for ultrasonic attack defense, the system comprising:

a voice activity detection circuit to detect voice activity in an audio signal received by a speech enabled device;

a jamming signal generator circuit to generate an ultrasonic jamming signal in response to the detected voice activity, the jamming signal to be broadcast over a loudspeaker; and a microphone to mix the broadcast ultrasonic jamming signal with an ultrasonic attack signal, to defend against an ultrasonic attack on the speech enabled device.

14. The system of claim 13, wherein the jamming signal generator circuit is further to broadcast the ultrasonic jamming signal for a broadcast time duration selected to be less than or equal to a duration of the detected voice activity.

15. The system of claim 13, wherein the ultrasonic jamming signal comprises a high pass filtered white noise signal generated by application of a high pass filter configured with a cut-off frequency at 18 kHz.

16. The system of claim 13, wherein the ultrasonic jamming signal comprises a plurality of tones ranging from 18 kHz to a selected upper frequency at an integral frequency spacing between the tones.

17. The system of claim 13, wherein the ultrasonic jamming signal comprises a periodic linear frequency sweep signal ranging from 18 kHz to a selected upper frequency over a period greater than or equal to 0.5 seconds.

18. The system of claim 13, wherein the ultrasonic jamming signal comprises a colored noise signal, the coloring selected to match a frequency response associated with speech signals.

19. A system for ultrasonic attack defense, the system comprising:

a key phrase detection circuit to detect a wake-on-voice key phrase in an audio signal received by a speech enabled device;

a jamming signal generator circuit to generate an ultrasonic jamming signal in response to the detected wake-on-voice key phrase, the jamming signal to be broadcast over a loudspeaker; and a microphone to mix the broadcast ultrasonic jamming signal with an ultrasonic attack signal, to defend against an ultrasonic attack on the speech enabled device.

20. The system of claim 19, wherein the jamming signal generator circuit is further configured to broadcast the ultrasonic jamming signal for a broadcast time duration selected to be less than or equal to a time window during which spoken commands are accepted following the wake-on-voice key phrase detection.

21. The system of claim 19, wherein the ultrasonic jamming signal comprises a high pass filtered white noise signal generated by application of a high pass filter configured with a cut-off frequency at 18 kHz.

22. The system of claim 19, wherein the ultrasonic jamming signal comprises a plurality of tones ranging from 18 kHz to a selected upper frequency at an integral frequency spacing between the tones.

23. The system of claim 19, wherein the ultrasonic jamming signal comprises a periodic linear frequency sweep signal ranging from 18 kHz to a selected upper frequency over a period greater than or equal to 0.5 seconds.

24. The system of claim 19, wherein the ultrasonic jamming signal comprises a colored noise signal, the coloring selected to match a frequency response associated with speech signals.

* * * * *